United States Patent [19]

O'Dell

[11] Patent Number: 4,566,301

[45] Date of Patent: Jan. 28, 1986

[54] METHOD AND MEANS OF MANUFACTURING SPIRALLY FLUTED TUBES

[75] Inventor: Donald E. O'Dell, Tulsa, Okla.

[73] Assignee: Aqua-Chem, Inc., Milwaukee, Wis.

[21] Appl. No.: 681,005

[22] Filed: Dec. 13, 1984

Related U.S. Application Data

[63] Continuation of Ser. No. 415,163, Sep. 7, 1982, abandoned.

[51] Int. Cl.[4] ..... B21D 15/04

[52] U.S. Cl. ..... 72/75; 72/78

[58] Field of Search ..... 72/75, 77, 78, 121

[56] References Cited

U.S. PATENT DOCUMENTS

| | | | |
|---|---|---|---|
| Re. 19,655 | 7/1935 | Reimann et al. | 72/75 |
| 1,203,306 | 10/1916 | Brinkman | 72/75 |
| 1,957,387 | 5/1934 | Cassady | 72/75 |
| 1,983,074 | 12/1934 | Durell | 72/284 |
| 3,486,357 | 12/1969 | Raisch | 72/121 |
| 3,662,578 | 5/1972 | Gleason et al. | 72/75 |
| 3,780,556 | 12/1973 | Johnson | 72/78 |
| 3,791,000 | 2/1974 | Kunze | 72/121 |
| 4,373,366 | 2/1983 | Tatsumi | 72/75 |

FOREIGN PATENT DOCUMENTS

| | | | |
|---|---|---|---|
| 1467459 | 1/1967 | France | 72/290 |
| 946407 | 1/1964 | United Kingdom | 72/75 |
| 990321 | 4/1965 | United Kingdom | 72/75 |

*Primary Examiner*—Lowell A. Larson

[57] ABSTRACT

A method and apparatus for the manufacture of spirally fluted tubes and which comprises a rotatable die for receiving the tube longitudinally therethrough during the forming operation for controlling the outer diameter thereof, a clamping apparatus for engaging the outer periphery of the tube and mounted on a movable base member for pulling the tube through the die, forming tools carried by the die for selectively exerting pressure against the outer periphery of the tube during the longitudinal movement thereof, and a reciprocal forming tool chuck apparatus engagable with the forming tools for controlling the inwardly directed pressure thereof against the tube to produce variable depth spiral grooves therealong.

10 Claims, 2 Drawing Figures

METHOD AND MEANS OF MANUFACTURING SPIRALLY FLUTED TUBES

This is a continuation of application Ser. No. 415,163 filed Sept. 7, 1982 now abandoned.

CROSS-REFERENCE TO RELATED APPLICATION

This is a resubmission of the subject matter of prior U.S. patent application Ser. No. 183,211, filed Sept. 2, 1980 by Donald E. O'Dell for "METHOD AND MEANS OF MANUFACTURING SPIRALLY FLUTED TUBES", which application, but not the invention therein, was expressly abandoned under 37 C.F.R. 1.138, the Notice of Abandonment having been mailed on Apr. 19, 1982.

BACKGROUND OF THE INVENTION

1. Field of the Invention

This invention relates to improvements in method and means for forming spirally fluted tubes and more particularly, but not by way of limitation, to apparatus for forming variable depth spiral grooves around the outer periphery of the tube and controlling the outer diameter of the tube during the fluting operation.

2. Description of the Prior Art

Finned tubes have long been utilized in the heat exchanger industry, and the like, for improving the dissipation of heat. Many of the tubes in use today comprise a cylindrical tube having a plurality of longitudinally spaced radially extending fins secured to the outer periphery thereof, and in some instances the tubes are provided with a continuous helical fin secured to the outer periphery of the tube. The inner periphery of these tubes is normally smooth and whereas the fins on the outer periphery of the tube improve the operation of the heat exchanger, the inner periphery does not provide any material increased effect in the efficiency of the tube. It has been found that twisting of the walls of the tube itself in order to deform the tube into a helical corrugated configuration along the length thereof provides an even more efficient heat dissipation in a heat exchanger in that both the inner and outer peripheries of the tube are deformed. These twisted tubes have certain disadvantages, however, in that it is difficult to control the dimensions of the outer diameters thereof, thus creating a problem in the installation of a plurality of the tubes in a heater, or the like, having predrilled or preformed bores therein for receiving the tubes therethrough. In addition, it is substantially impossible to predetermine a depth for the fluting or spiral groove formed by the tube twisting operation, and the tube twisting operation is completely ineffective in the event it is desirable to provide a tube having alternate grooves sections and smooth walled sections.

SUMMARY OF THE INVENTION

The present invention contemplates a novel method and means for producing spirally fluted tubes in a manner for overcoming the foregoing disadvantages. The novel apparatus comprises a rotatable die means for receiving the tube longitudinally therethrough, and a movable clamping means for engaging the tube and pulling the tube through the die. Forming tool means are carried by the die means and are engagable with the outer periphery of the tube moving therethrough. A reciprocal forming chuck means is provided for selective engagement with the forming tools to control the pressure of the forming tools against the outer periphery of the tube whereby the depth of deformation of the wall of the tube may be controlled, thus not only providing a spiral groove of a predetermined depth, but also permitting the forming of alternate fluted sections and smooth walled sections along the length of the tube. The novel method and means for forming fluted tubes is simple and efficient in operation and economical in construction.

DETAILED DESCRIPTION OF THE PREFERRED EMBODIMENT

Figure 1:
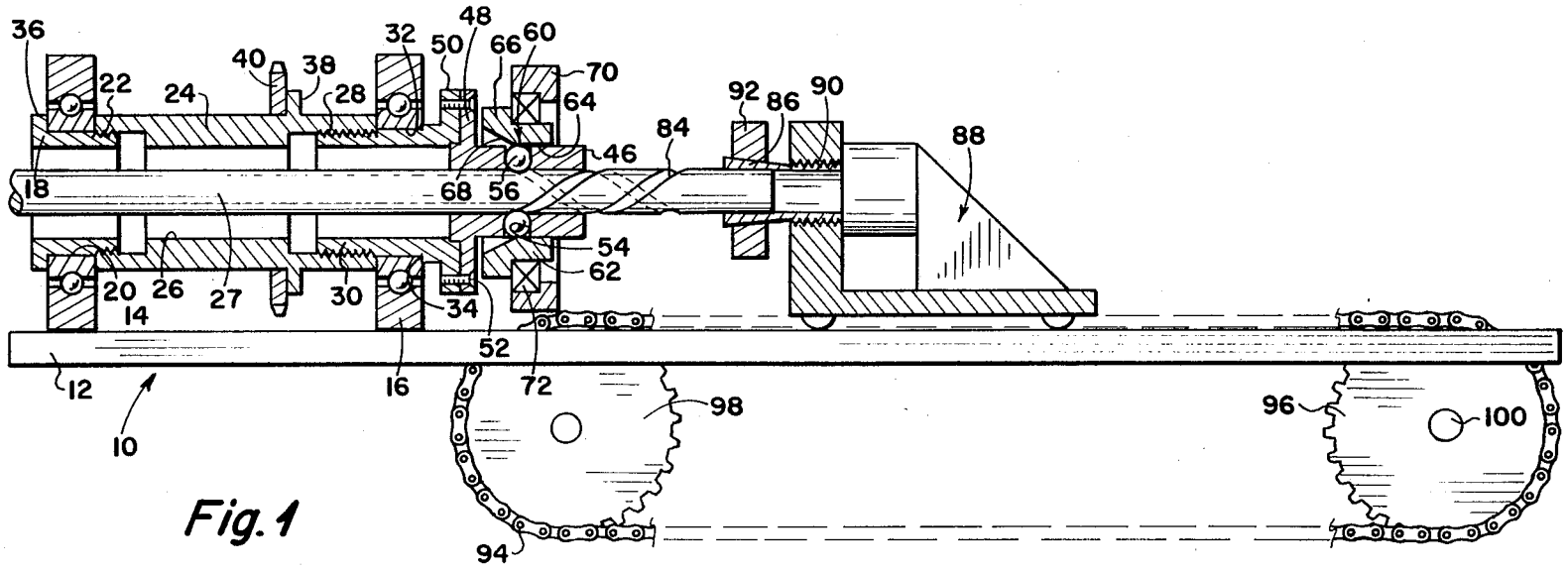
FIG. 1 is a sectional elevational view of an apparatus embodying the invention for forming spiral fluted tubing.

Referring to the drawings in detail, reference character 10 generally indicates an apparatus for forming spiral fluting in tubes and comprising a suitable base member or support structure 12 of any well known type having a pair of spaced pillow block bearings 14 and 16 mounted thereon in any suitable manner. A flanged sleeve 18 extends through the central bore 20 of the bearing 14 and is provided with an external threaded portion 22 on the inner end thereof for threaded connection with one end of a drive shaft 24. The drive shaft 24 is provided with a central bore 26 extending longitudinally therethrough to receive a tube 27 therein for a purpose as will be hereinafter set forth. The inner periphery of the opposite end thereof is threaded as shown at 28 for threaded connection with one end of a flanged sleeve 30 which extends through a central bore 32 of the bearing 16.

Figure 2:
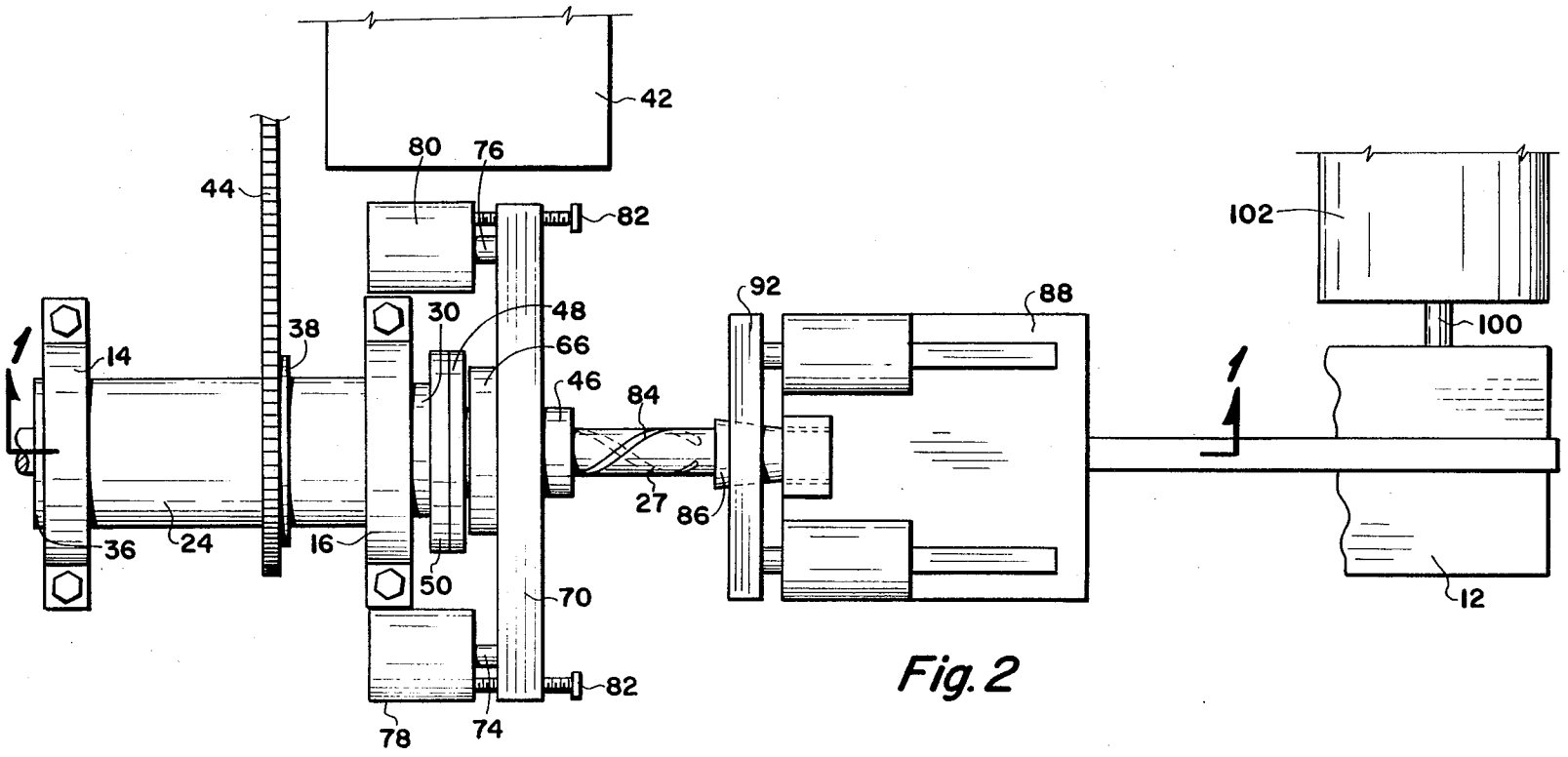
FIG. 2 is a plan view of an apparatus embodying the invention for forming spiral fluted tubing.

One end of the drive shaft 24 bears against the inner face of the bearing 16, as particularly shown in FIG. 1, and an annular shoulder 34 is provided on the outer periphery of the sleeve 32 for engagement with the outer face of the bearing 16, thus holding the drive shaft 24 and sleeve 32 against longitudinal movement with respect to the bearing 16. The opposite end of the drive shaft 24 bears against the inner face of the bearing 14, and an outwardly extending circumferential flange 36 provided on the outer end of the sleeve 18 bears against the outer face of the bearing 14, thus holding the drive shaft 24 and sleeve 18 against longitudinal movement with respect to the bearing 14. The outer periphery of the sleeves 18 and 30 are in engagement with the inner periphery of the inner race of the bearings 14 and 16, respectively, thus permitting free rotation of the drive shaft 24 and sleeves 18 and 30 about their respective longitudinal axes for a purpose as will be hereinafter set forth. An outwardly extending circumferential flange 38 is provided on the outer periphery of the drive shaft 24 interposed between the bearings 14 and 16 for receiving one side of a suitable sprocket member 40 thereagainst. The sprocket 40 is operably connected with a suitable variable speed driver 42 (FIG. 2) by a drive chain 44 and may be keyed or otherwise secured to the outer periphery of the drive shaft 24 whereby rotation of the sprocket 40 is transmitted to the drive shaft 24 and sleeves 18 and 20.

A sleeve 46 having an outwardly extending circumferential flange 48 is disposed in end-to-end relation with the sleeve 30 and the flange 48 is disposed against the outer surface of a similar outwardly extending circumferential flange 50 provided on the outer end of the sleeve 30. The flange 48 is secured to the flange 50 in any suitable manner, such as by a plurality of spaced screws or bolts 52 whereby rotation of the drive shaft 24 and sleeve 30 is transmitted to the sleeve 46.

A plurality of spaced bores 54 are provided in the sidewall of the sleeve 46, each bore 54 receiving a suitable forming tool 56 therein. The forming tool 56 as shown herein is a ball, but it is to be understood that the tool may be pins, rollers, balls, or a combination of all three, if desired. Of course suitable means is preferably provided for limiting the radially inward movement of the balls 56 for precluding accidental loss of the balls from the respective bores 54. For example, the inner end of each bore 54 may be provided with radially inwardly directed shoulder means of a configuration conforming to the outer periphery of the tool whereby the tool may project radially inwardly from the inner periphery of the sleeve 46 through a preselected distance, but it retained against complete removal from the bore in the radially inward direction with respect to the sleeve 46.

A forming tool chuck member 60 is slidably disposed around the outer periphery of the sleeve 46 and comprises a sleeve 62 having a centrally disposed bore 64 of a diameter preferably slightly greater than the outer diameter of the sleeve 46 for ease of relative longitudinal movement therebetween. An outwardly extending circumferential flange 66 is provided at one end of the sleeve 62 for engagement with the flange 48 for limiting the movement of the chuck 60 in one direction. The bore 64 is flared radially outwardly in the proximity of the flange 66 as shown at 68 in FIG. 1 for a purpose as will be hereinafter set forth. The chuck 60 is supported within a movable or reciprocal die holder block 70 by a suitable bearing means 72 which is disposed around the outer periphery of the sleeve 62 and against the flange 66. The block 70 is secured to a pair of spaced reciprocal rams or rods 74 and 76 in any suitable manner (not shown), the rams preferably being the piston rods of suitable hydraulic cylinders 78 and 80, respectively, but not limited thereto. A plurality of adjusting screws 82 extend through the block 70 for engagement with the cylinders 78 and 80 for adjustment of the distance of the block 70 therefrom, thus permitting control of the stroke of the block 70 as will be hereinafter set forth and determining the position of the chuck 60 with respect to the forming die means 56 to control the depth of penetration thereof.

The tube 27 may be of any desired size upon which it is desirable to produce a spiral fluting as shown at 84, and extends through the drive shaft 24 and sleeve 46 and therebeyond for engagement by a suitable collet 86. The collet 86 is secured to a movable base means 88 in any suitable manner, such as by a threaded connection 90 shown in FIG. 1. A collet clamp 92 is movably secured around the outer periphery of the collet 86, as is well known, and is longitudinally adjustable with respect thereto for securely clamping the tube 27 within the collet 86 in the usual or well known manner. The base means 88 is operably connected with an endless chain means 94 for reciprocal movement therewith. The chain means 94 extends around and between a pair of spaced sprockets 96 and 98, and one of the sprockets, as for example the sprocket 96, is keyed or otherwise secured to a drive shaft 100 of a power driver means 102, which may be an electric motor, or the like, as desired. Rotation of the sprocket 96 in one direction moves the chain 94 in a direction for moving the base means 88 in a right hand direction as viewed in FIG. 1, whereas rotation of the sprocket 96 in a reverse direction moves the chain 94 in a direction for moving the base means 88 in a left hand direction as viewed in FIG. 1, all for a purpose as will be hereinafter set forth. Alternatively, the base means 88 may be secured to the chain means 94 in a manner whereby the drive sprocket 96 may rotate in a common direction, and the base means 88 will follow the movement of the chain means through the upper and lower courses thereof to provide forward and reverse movement for the base means 88.

In use, the tube 27 may be passed through the sleeve 18, drive shaft 24, sleeve 30 and sleeve 46 and the outer end thereof may be inserted into the collet 86, whereupon the collet clamp 92 may be utilized in the normal manner for securely clamping the collet 86 around the outer periphery of the tube. The forming tools 56 may be pressed against the outer periphery of the tube 27 by the pressure of the forming tool chuck 60 against the outermost portions of the tools 56 whereby the tube will be deformed at the point of contact with the tools 56.

The greatest pressure of the tools 56 against the outer periphery of wil occur when the forming tool chuck 60 is positioned in such a manner that the bore 64 is in engagement with the forming tools. When a lesser pressure of the forming tools 56 against the tube 27 is desired, the chuck 60 may be "backed off" whereby the taper 68 engages the forming tools. In order to "back off" the chuck 60, the cylinders 78 and 80 may be actuated for moving the die holder 70 in a right hand direction as viewed in the drawings, thus moving the chuck therewith for relieving or lessening the pressure of the forming tools against the outer periphery of the tube 27. In this manner the depth of deformation created by the forming tools may be controlled.

When the chuck 60 has been properly orientated with respect to the forming tools 56 to achieve the desired depth of deformation of the tube 27, the drive means 102 may be activated whereby the base means 88 will be moved in a direction away from the die or sleeve 46, thus pulling the tube 27 longitudinally through the apparatus 10. Simultaneously with the longitudinal movement of the tube 27 through the apparatus 10, the variable speed driver 42 is activated for transmitting rotation through the drive shaft 24 to the die sleeve 46 whereby the forming tools 56 will be moved circumferentially about the outer periphery of the tube 27. In this manner, the tube 27 is deformed in a spiral configuration due to the combined longitudinal movement of the tube and the circumferential movement of the forming tools. Of course, the amplitude of the spirals of the deformation may be controlled by the speed of longitudinal movement of the tube 27 in combination with the speed of circumferential movement of the forming tools therearound.

In the event it is desirable to provide alternate spiral fluted sections and smooth walled sections along the length of the tube 27, the spiral fluting may be accomplished in the manner as hereinbefore set forth, and at the proper spacing wherein the smooth walled portion is desired, the cylinders 78 and 80 may be activated for moving the forming chuck 60 in a right hand direction as viewed in the drawings through a sufficient distance for aligning the tapered portion 68 with the forming tools 56 in such a manner as to release any pressure of the tools 56 against the outer periphery of the tube 27.

It will be apparent that suitable microswitch means (not shown) may operably connect with the cylinders 78 and 80 for backing the chuck 80 to a position of released pressure against the chuck 80 to a position of released pressure against the forming tools 56 at that point wherein the smooth wall is desired. In order to resume the sprial fluting operation, the cylinders 78 and 80 may be activated in a reverse direction for moving the chuck 60 in a left hand direction as viewed in the drawings for increasing the pressure of the forming tools 56 against the outer periphery of the tube, as hereinbefore set forth.

The inner diameter of the die sleeve 46 is preferably of a relatively close tolerance with respect to the outer diameter of the tube 27 extending therethrough. Consequently, as the tube is moved longitudinally through the sleeve 46, the outer periphery of the tube is held to a preselected dimension since the die 46 contains the tube within the selected diametric limits therefor. Of course, the completed tube 27 may be removed from the apparatus 10 by releasing the engagement of the collet 86 therewith and withdrawing the properly fluted tube from the apparatus 10.

From the foregoing it will be apparent that the present invention provides a novel apparatus for forming spirally fluted tubes in a manner wherein the depth of the fluting may be controlled and the outer diameter of the completed tubing may be maintained within predetermined tolerances. The novel apparatus comprises drive shaft means operably connected with a forming die means, and collect means for grasping the tube and pulling the tube through the forming die means. The forming die means includes rotatable forming tools selectively engagable with the outer periphery of the tubing moving thereover and forming tool chuck means engagable with the forming tools for controlling the engagement pressure of the tools with the tube for controlling the depth of deformation of the tube.

Whereas the present invention has been described in particular relation to the drawings attached hereto, it should be understood that other and further modifications, apart from those shown or suggested herein may be made within the spirit and scope of this invention.

What is claimed is:

1. A method of forming spirally-fluted tubing which comprises moving a tube longitudinally through a rotatable forming die, applying the formable pressure against the outer periphery of the tube during movement of the tube through the rotating forming die, and varying the pressure applied against the outer periphery of the tube during the forming operation without interruption thereof and as required for controlling the depth of deformation during the spiral fluting operation, wherein the forming die comprises sleeve means having a plurality of circumferentially spaced bores and ball means disposed within said bores, and cylindrical chuck means having a central passageway therethrough and disposed in surrounding relation to said sleeve means, said passageway having an outwardly flared surface adapted to engage said ball means for applying tube deforming pressure thereto and including the step of selectively-moving said cylindrical chuck means relative to said ball means during movement of said tube through said forming die so that differential portions of said surface will engage said ball means to modify the pressure thereon, so that the depth of deformation will be modified.

2. Apparatus as set forth in claim 1 wherein the forming die means internal passageway means is of a diametric dimension of a relatively close tolerance with respect to the outer diameter of the tube for controlling the outer diameter of the tube during the spiral fluting operation.

3. A method as set forth in claim 1 and including the step of controlling the applitude of the spiral during the spiral fluting operation.

4. The method set forth in claim 1 and including the step of moving said chuck means bidirectionally during the passage of said tube through said forming die so that selected areas of said tube will have flutes of different depth or fluted and unfluted areas.

5. Apparatus for forming spiral flutes on a tube comprising:

a rotatable drive shaft having a passageway extending longitudinally therethrough for slidably receiving a tube therein; 'a sleeve secured to said drive shaft for rotation simultaneously therewith and having a plurality of circumferentially spaced bores therein and having a passageway extending therethrough for passage of a tube to be fluted therethrough;

forming tools disposed in said sleeve bores for engagement with the outer periphery of a tube for deformation thereof;

a cylindrical chuck having a central passageway therethrough of an internal diameter larger than and receiving said sleeve, the passageway including a cylindrical portion terminating in a radially outwardly flared portion to provide pressure control of the forming tools against the outer tube periphery;

a variable drive connected with said drive shaft for rotation of said drive shaft and thereby said sleeve;

a collect means spaced from said drive shaft for clamping engagement with a tube;

a movable base means supporting said collect means for movement in directions away from and towards said drive shaft whereby the tube may be pulled through said sleeve and past said forming tools; and positioning means disposed about said chuck to selectably longitudinally position said chuck relative to said sleeve whereby the pressure of said forming tools against the periphery of a tube may be varied while spiraled flutes are being formed in the tube, the depth of the flutes being thereby continuously selectably variable.

6. Apparatus as set forth in claim 5 wherein the forming tool means comprise ball members engagable with the outer periphery of the tube to provide said deforming thereof.

7. Apparatus as set forth in claim 6 wherein said positioning means comprises a movable die holder and the chuck is rotatably supported by said movable die holder and said apparatus further includes reciprocal rod means operably connected with the movable die holder for reciprocation thereof to control the relative position of the outwardly flared portion.

8. Apparatus as set forth in claim 5 and including means operably connecting the movable base means with the drive and comprising sprocket means powered by the power supply, and endless chain means extending around and between the sprocket means and connected with the movable base means for transmitting movement thereto.

9. Apparatus as set forth in claim 5 wherein said positioning means comprises movable die holder means supporting the rotatable chuck, bearing means interposed between the rotatable chuck and said movable die holder means, and reciprocal rod means connected with the movable die holder means for transmitting reciprocal movement thereto whereby said chuck may be adjusted longitudinally with respect to the forming tool means for positioning the variable diameter inner periphery as required to provide the desired pressure of the forming tool means against the outer periphery of the tube during a spiral fluting operation.

10. Apparatus as set forth in claim 9 wherein the central passageway is of a diametric dimension of relatively close tolerance with respect to the outer diameter of the tube for controlling the outer diameter of the tube during the spiral fluting operation.

* * * * *